US007036852B2

(12) United States Patent
Cho

(10) Patent No.: US 7,036,852 B2
(45) Date of Patent: May 2, 2006

(54) SYSTEM FOR OPERATING THE ROD OF A GLOVE BOX

(75) Inventor: Joung-hwan Cho, Icheon (KR)

(73) Assignee: Hyundai Mobis Co., Ltd., Seoul (KR)

( * ) Notice: Subject to any disclaimer, the term of this patent is extended or adjusted under 35 U.S.C. 154(b) by 0 days.

(21) Appl. No.: 10/743,804

(22) Filed: Dec. 24, 2003

(65) Prior Publication Data

US 2005/0104380 A1 May 19, 2005

(30) Foreign Application Priority Data

Nov. 19, 2003 (KR) ..... 10-2003-0082292

(51) Int. Cl.
*E05C 1/06* (2006.01)

(52) U.S. Cl. ..... 292/33; 292/39; 292/40; 292/142; 292/160; 292/DIG. 61; 296/37.8; 296/37.12

(58) Field of Classification Search ..... 292/39, 292/40, 32–36, 142, 172, DIG. 61, 160, 279; 296/37.8, 37.12
See application file for complete search history.

(56) References Cited

U.S. PATENT DOCUMENTS

| | | | | | |
|---|---|---|---|---|---|
| 14,112 | A | * | 1/1856 | Peck | 292/39 |
| 191,699 | A | * | 6/1877 | McClellan et al. | 292/39 |
| 228,241 | A | * | 6/1880 | Zimmerman | 292/39 |
| 266,903 | A | * | 10/1882 | Schertzer | 292/33 |
| 374,391 | A | * | 12/1887 | Born | 292/142 |
| 660,403 | A | * | 10/1900 | Sutton | 292/39 |
| 692,804 | A | * | 2/1902 | Turney | 292/32 |
| 722,162 | A | * | 3/1903 | Louis | 292/7 |
| 1,251,467 | A | * | 1/1918 | Blixt et al. | 109/61 |
| 1,376,233 | A | * | 4/1921 | Swan | 292/39 |
| 1,633,173 | A | * | 6/1927 | Freedman et al. | 70/118 |
| 1,892,512 | A | * | 12/1932 | Kemp | 292/39 |
| 2,489,957 | A | * | 11/1949 | Davis | 292/33 |
| 3,308,579 | A | * | 3/1967 | Thams | 49/192 |
| 3,778,079 | A | * | 12/1973 | Vornberger et al. | 280/149.2 |
| 4,058,333 | A | * | 11/1977 | Roe et al. | 292/172 |
| 4,288,944 | A | * | 9/1981 | Donovan | 49/395 |
| 4,335,816 | A | * | 6/1982 | Rager | 206/308.3 |
| 4,476,700 | A | * | 10/1984 | King | 70/99 |
| 4,486,040 | A | * | 12/1984 | Strangward | 292/160 |
| 4,932,696 | A | * | 6/1990 | White | 292/336.3 |
| 5,067,755 | A | * | 11/1991 | James | 292/33 |
| 5,280,881 | A | * | 1/1994 | Karmin | 70/279.1 |

(Continued)

FOREIGN PATENT DOCUMENTS

DE 733665 * 3/1943

(Continued)

*Primary Examiner*—Brian E. Glessner
*Assistant Examiner*—Carlos Lugo
(74) *Attorney, Agent, or Firm*—Greenblum & Bernstein, P.L.C.

(57) ABSTRACT

A system for operating a rod of a glove box employs a rack and pinion gear to operate the rod for functioning as a locking device of a glove box. The number of parts for operating the rod of the glove box is decreased in comparison with the prior art, and assembling processes are decreased, thereby improving efficiency.

2 Claims, 3 Drawing Sheets

U.S. PATENT DOCUMENTS 5,437,485 A * 8/1995 Goldschmidt ..... 292/142
5,481,889 A * 1/1996 Richard et al. ..... 70/118
5,482,334 A * 1/1996 Hotzl ..... 292/357
5,826,922 A * 10/1998 Wernig ..... 292/39
5,992,188 A * 11/1999 Saunders ..... 70/120
6,030,019 A * 2/2000 Stiltner et al. ..... 296/57.1
6,116,662 A * 9/2000 Johnson ..... 292/142
6,120,069 A * 9/2000 Taranto ..... 292/35
6,152,512 A * 11/2000 Brown et al. ..... 296/37.12
6,607,221 B1 * 8/2003 Elliott ..... 292/33
6,669,243 B1 * 12/2003 Katoh et al. ..... 292/34

FOREIGN PATENT DOCUMENTS

| | | | |
|---|---|---|---|
| DE | 1021271 | * | 12/1957 |
| GB | 369736 | * | 3/1932 |
| JP | 2003-13655 | | 1/2003 |
| KR | 2002048030 | * | 6/2002 |
| KR | 2003076114 | * | 9/2003 |
| KR | 2004035927 | * | 4/2004 |

* cited by examiner

SYSTEM FOR OPERATING THE ROD OF A GLOVE BOX

RELATED APPLICATION

The present disclosure relates to subject matter contained in Korean application No. 2003-82292, filed on Nov. 19, 2003, which is herein expressly incorporated by reference its entirety.

BACKGROUND OF THE INVENTION

1. Field of the Invention

The present invention relates to a system for operating the rod of a glove box, and more particularly, to a system for operating the rod of a glove box employing a rack gear and a pinion gear as a device for operating a rod of a glove box to decrease the number of parts and simplify its structure.

2. Description of the Related Art

Generally, a glove box for an automobile is installed in front of the seat next to a driver, and used as a place for storing small items.

Hereinafter, a prior art glove box will be described in conjunction with the accompanying drawings.

As shown in FIG. 1, the prior art glove box 1 is provided with a receiving case 3 for forming a predetermined space on an inner side, and the receiving case 3 has a front panel 5 at its front surface.

A knob 6 is installed at an open part of one side of the front panel 5, and the glove box 1 is opened and closed from an instrument panel by means of a method where the knob 6 is pulled by a finger inserted therein.

By operating the knob 6, the glove box 1 is opened/closed as a rod protruded outward from a side part of the glove box 1 located at the rear side of the front panel 5 is moved.

Various types of devices are used as a system for operating a rod by operating the knob 6, generally, two links operated by the knob 6 are installed to correspond to each other, and each rod is installed at the protrusions of the links.

The system for operating the rod of a glove box has a large number of parts, and processes for assembling the parts are increased to decrease efficiency.

Further, a relatively large space for installing the rod operating system in the glove box results in the problem of the thickening of the glove box.

SUMMARY OF THE INVENTION

It is an object of the present invention to provide a system for operating the rod of a glove box capable of reducing the number of parts by simplifying the structure for operating the rod used in a locking device of the glove box and improving productability by decreasing the size of the installation space.

In accordance with the present invention, there is provided a system for operating a rod of a glove box comprising a bar shaped lock lever connected to a rear side of a knob installed at a front surface of a glove box to be engaged by operation of the knob; a driving gear rotated by the lock lever and provided with a pinion gear at one side; a driving rod provided with a first rack gear rotated with the pinion gear of the driving rotary gear at one side and a second rack gear formed at its upper side, and moved inward protruding to one side surface of the glove box by rotation of the driving rotary gear; a driven rotary gear provided with circular teeth rotated with one side of the second rack gear of the driving rod; a driven rod provided with a driven rack gear engaged with the other side of the driven rotary gear, and moved inward in a state protruding to the other surface of the glove box by the driven rotary gear rotated when the driving rod is operated; and a return member provided with one end fixed to the driving rod and the other end fixed to the glove box such that the driven rod and the driving rod are returned to an outer side of the glove box to thereby provide a return force.

Preferably, the driving rotary gear is provided with a stopper for limiting a movement distance of the driving rod moved by the return member as the stopper is caught by one end of the driving rod in the vicinity of the first rack gear.

In addition, the system further comprises a guide plate fixed to the glove box, and formed as a single plate provided with a hook for fixing one end of the return members and a hooking groove for guiding the driving rod.

According to the present invention, the number of parts for operating a rod of a glove box is reduced; therefore, the number of assembly processes is decreased to thereby improve efficiency.

BRIEF DESCRIPTION OF DRAWINGS

Other objects and aspects of the present invention will become apparent from the following description of embodiments with reference to the accompanying drawings in which.

DESCRIPTION OF THE PREFERRED EMBODIMENT

Hereinafter, a preferred embodiment of the present invention will be apparent from the following description in conjunction with the accompanying drawings.

Figure 1:
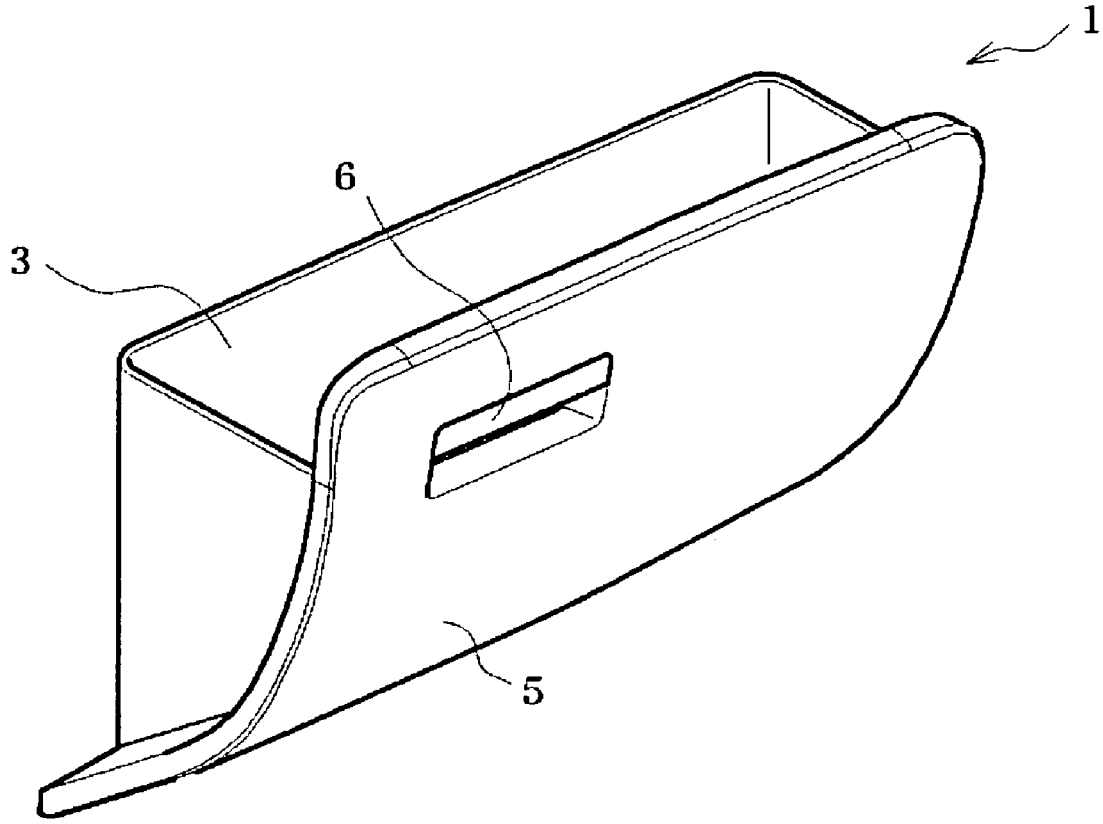
FIG.1 (PRIOR ART)
FIG. 1 is an exterior view for illustrating a conventional glove box.
Figure 2:
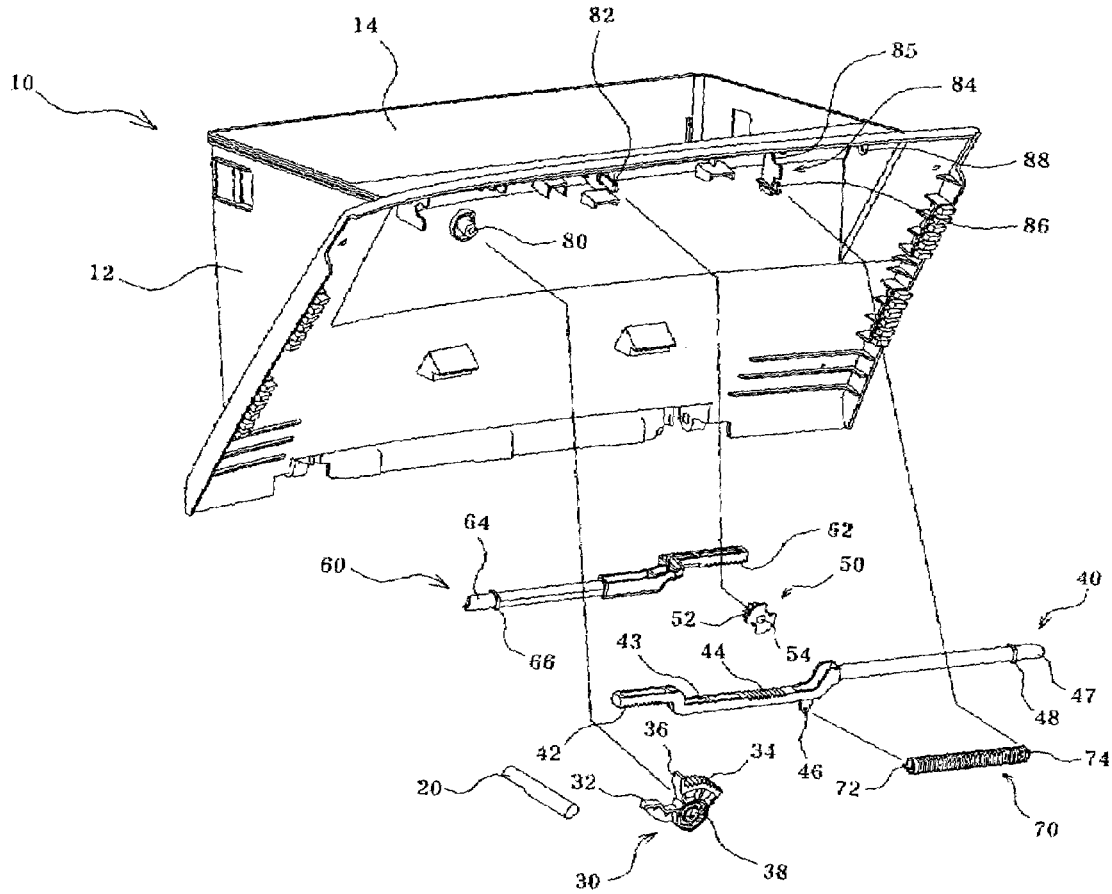
FIG. 2 is a view for illustrating a system for operating the rod of a glove box in accordance with an embodiment of the present invention.
Figure 3:
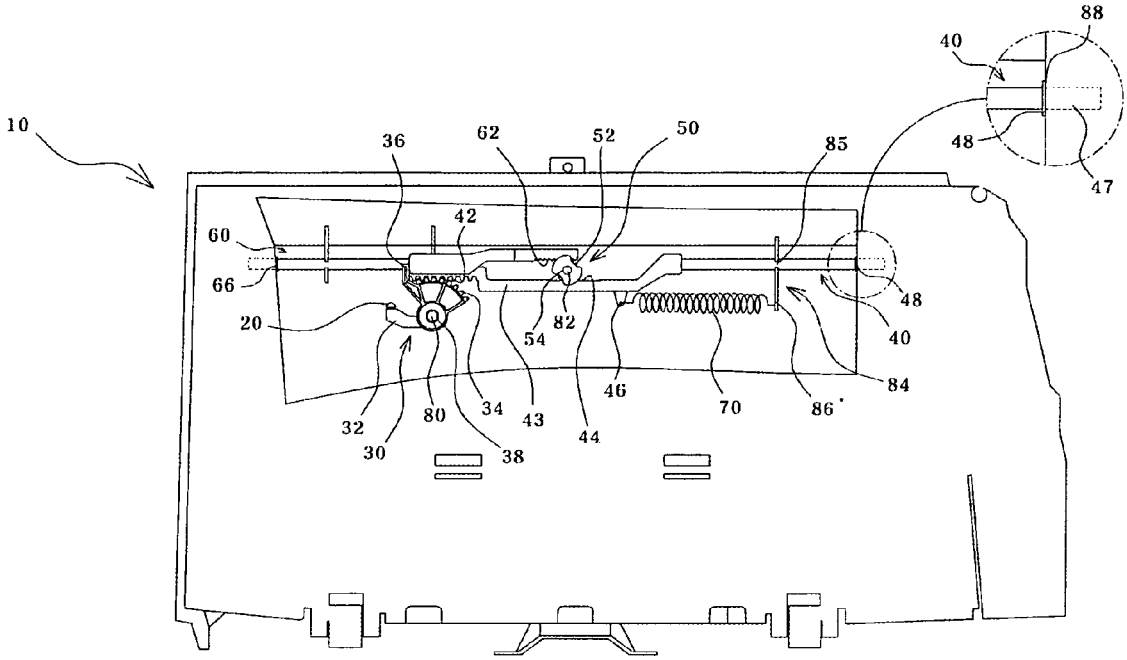
FIG. 3 is a view for illustrating an assembled state of a system for operating the rod of a glove box in accordance with the embodiment of the present invention.
Figure 4:
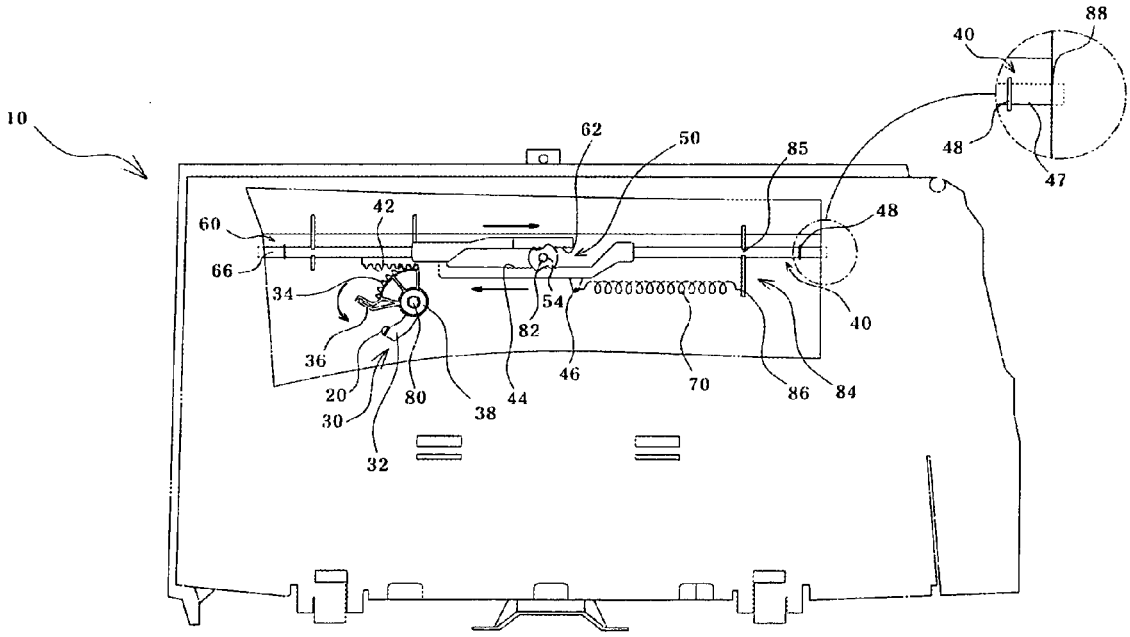
FIG. 4 is a view for illustrating a state that the system for operating a rod of a glove box shown in FIG. 3 is operated.

FIG. 2 is a view for illustrating a system for operating a rod of a glove box in accordance with an embodiment of the present invention, FIG. 3 is a view for illustrating an assembled state of a system for operating the rod of a glove box in accordance with an embodiment of the present invention, and FIG. 4 is a view for illustrating a state that the system for operating the rod of a glove box shown in FIG. 3.

As shown in the drawings, the glove box 10 is provided with side surfaces 12, and a receiving case 14 forming a predetermined space is formed between the side surfaces 12.

The glove box 10 is provided with a knob (not shown) that a user operates at its front surface, and the knob is connected to a bar shaped lock lever 20 at its rear side.

The lock lever 20 is moved by operation of the knob, the knob is provided with a spring device, therefore, the lock lever 20 is also returned to its original state as the knob moves back to the original position when a user releases the knob.

The driving rotary gear 30 rotated by the lock lever 20 is provided with a catching bar 32 protruded to convert vertical movement of the lock lever 20 into a rotational movement.

In addition, a pinion gear 34 is formed at one side of the driving rotary gear 30 in a circular motion, and a stopper 36 protruding from one end of the pinion gear 34.

Further, the rotary shaft of the driving rotary gear 30 is provided with a mounting hole 38 formed and mounted on the glove box 10.

A first rack gear 42 is formed at a lower surface of a left side (hereinafter, with reference to FIG. 2) of the driving rod 40 to be engagedly moved with the pinion gear 34 of the driving rotary gear 30.

And, a second rack gear 44 is formed at an upper side surface of a connecting bar 43 formed with with downward steps from the first rack gear 42.

Further, formed at a right side of the driving rod 40 is an operating pin 47 protruded and operated from the side surface 12 of the glove box, and a catching unit 48 fixed to the side surface 12 of the glove box to limit movement distance of the operating pin 47.

A driven rotary gear 50 for rotating with the second rack gear 44 of the driving rod 40 has a circular plate shape having a predetermined thickness, a circular teeth formed along a circular periphery of the driven rotary gear 50, and a hollow hole 54 formed at its center.

A driven rack gear 62 is formed at a lower side surface of a right side (with reference to FIG. 2) of the driven rod 60 for receiving movement by rotating with the driven rotary gear 50 to be rotated with the driven rotary gear 50.

In addition, the driven rod 60, similar to the drive rod 40, is provided with an operating pin 64 and a catching piece 66 formed at its left side.

When the lock lever 20 is returned to its original position, a coil spring 70 is used as a returning member for moving the driving rod 40 to its original position, and a first hook 72 formed at one end is installed at a hooking hole 46 formed at a lower side of the driving rod 40.

Further, a second hook 74 is formed at the other end of the spring 70, and the second hook 74 is hooked and fixed to a catching part 86 of a guide plate 84.

The guide plate 84 is fixed to the glove box 10 since the catching part 86 where the spring 70 is fixed and the hooking groove 85 for guiding the movement of the driving rod 40 are formed in a single plate.

By using the guide plate 84, the catching part 86 and the catching groove 85 are formed as a single part to reduce the number of parts and assembly processes.

The glove box 10 is first provided with a protrusion 80 and a second protrusion 82 for mounting the driving rotary gear 30 and the driven rotary gear 50.

In addition, both sides 12 of the glove box 10 are provided with a through-hole 88 for moving the operation pins 47 and 64.

Operation of the system for operating the rod of a glove box in accordance with the embodiment of the present invention will be described hereinafter.

FIG. 3 is a view for illustrating the system for operating a rod of a glove box in accordance with the embodiment of the present invention, with the catching pieces 48 and 66 fixed with the side surface 12 of the glove box and operating pins 47 and 64 protruding to an outer side of the through-hole 88.

When a user pulls the knob formed at the front surface of the glove box 10 in this state, the lock lever 20 engaged therewith is moved to press the catching bar 32 of the driving rotary gear 30 to thereby rotate the driving rotary gear 30 counterclockwise (hereinafter, with reference to FIG. 4).

The first rack gear 42 engaged with the pinion gear 34 of the driving rotary gear 30 is also moved to the left side to move the driving rod 40 to the left.

In accordance with the movement to the left of the driving rod 40, the operating pin 47 is moved inside the glove box 10, and the driven rotary gear 50 engaged with the second rack gear 44 formed on an upper side of the connecting bar 43 is rotated clockwise.

The driven rack gear 62 engaged with the upper side of the driven rotary gear 50 is moved to the right. As a result, the driven rod 60 is also moved to the right, thereby moving the operating pin 64 of the driven rod 60 inside the glove box 10.

On the other hand, the spring 70 is extended to the left side, when the driving rod 40 is moved to the left side, as the first hook 72 of one end of the spring 70 is fixed to the catching hole 46 of the driving rod 40 and the second hook of the other end is fixed to the catching part 86 fixed to the glove box 10.

By pulling the knob, the operating pins 47 and 64 are moved to an inner side of the glove box 10 to release the locking device of the glove box to open the glove box 10.

When the glove box 10 is moved to the original position in a state that a user releases the knob, the driving rod 40 is moved to the right side by a recovery force of the spring 70.

As a result, the driven rotary gear 50 is rotated counterclockwise to move the driven rod 60 to the left side, and the driving rotary gear 30 is rotated clockwise to a position where the stopper 36 meets one end of the driving rod 40.

By means of moving the driving rod 40 and the driven rod 60, the operating pins 47 and 64 are moved to the outer side of the side surface 12 until the catching pieces 48 and 66 are hooked by the side surface 12, thereby locking the glove box 10.

As described hereinabove, the system for operating a rod of a glove box in accordance with the present invention provides effects of reducing production costs since the number of parts is decreased in comparison with the prior art, improving a efficiency, and maximizing a space utility due to a reduction in the space used by a simple structure, by means of a rod operating device using a rack gear and a pinion gear.

While this invention has been described in connection with what is presently considered to be the most practical and preferred embodiment, it is to be understood that the invention is not limited to the disclosed embodiment, but on the contrary, it is intended to cover various modification within the spirit and scope of the appended claims.

What is claimed is:

1. A system for operating a rod of a glove box comprising:

a bar shaped lock lever connected to a rear side of a knob installed at a front surface of a glove box to be engaged by an operation of the knob;

a driving rotary gear rotated by the lock lever and provided with a pinion gear at one side thereof;

a driving rod provided with a first rack gear engaged with the pinion gear of the driving rotary gear and a second rack gear formed at an upper side thereof, the driving rod being moved inward from a position in which it protrudes from one side surface of the glove box by a rotation of the driving rotary gear;

a driven rotary gear provided with teeth which are engaged with the second rack gear of the driving rod;

a driven rod provided with a driven rack gear engaged with the driven rotary gear, the driven rod being moved inward from a position in which it protrudes from another side surface of the glove box by rotation of the driven rotary gear when the driving rod is operated;

a return member provided with one end fixed to the driving rod and the other end fixed to the glove box so as to provide a returning force such that the driven rod and the driving rod are returned to positions in which they protrude from the side surfaces of the glove box; and a guide plate fixed to the glove box, and formed as a single plate provided with a hook that fixes the other end of the return member and a hooking groove for guiding the driving rod.

2. The system according to claim 1, wherein the driving rotary gear is provided with a stopper that limits movement distance of the driving rod moved by the return member as the stopper is engaged by one end of the driving rod adjacent to the first rack gear.

* * * * *